US009094769B2

(12) United States Patent
Bisgaard et al.

(10) Patent No.: US 9,094,769 B2
(45) Date of Patent: Jul. 28, 2015

(54) HEARING AID OPERATING IN DEPENDENCE OF POSITION

(71) Applicant: GN ReSound A/S, Ballerup (DK)

(72) Inventors: Nikolai Bisgaard, Lyngby (DK); Andrew Burke Dittberner, Andover, MN (US); Charlotte Thunberg Jespersen, Copenhagen O (DK); Wang Fang, Roskilde (DK)

(73) Assignee: GN RESOUND A/S, Ballerup (DK)

( * ) Notice: Subject to any disclaimer, the term of this patent is extended or adjusted under 35 U.S.C. 154(b) by 81 days.

(21) Appl. No.: 13/932,815

(22) Filed: Jul. 1, 2013

(65) Prior Publication Data

US 2015/0003652 A1 Jan. 1, 2015

(30) Foreign Application Priority Data

Jun. 27, 2013 (DK) ..... 2013 70356
Jun. 27, 2013 (EP) ..... 13173995

(51) Int. Cl.
*H04R 25/00* (2006.01)

(52) U.S. Cl.
CPC ..... *H04R 25/50* (2013.01)

(58) Field of Classification Search
CPC ..... H04R 25/00; H04R 25/30; H04R 25/60; H04R 25/65; H04R 25/70; H04R 25/305; H04R 25/456; H04R 25/505; H04R 25/552; H04R 25/554; H04R 25/606; H04R 25/652; H04R 2225/021; H04R 2225/025; H04R 2225/63; H04R 2225/67; H04R 2460/13; A61N 1/36032; A61F 2/18; A61F 2002/183
USPC ..... 381/23.1, 60, 312–315, 322, 324, 328, 381/330; 600/25; 607/55, 57
See application file for complete search history.

(56) References Cited

U.S. PATENT DOCUMENTS

| | | | |
|---|---|---|---|
| 7,773,763 | B2 | 8/2010 | Pedersen |
| 7,853,030 | B2 | 12/2010 | Grabson et al. |
| 8,457,335 | B2 | 6/2013 | Imamura et al. |
| 2007/0140512 | A1 | 6/2007 | Hain et al. |
| 2010/0092017 | A1 | 4/2010 | Waldmann |
| 2011/0293123 | A1 | 12/2011 | Neumeyer et al. |

FOREIGN PATENT DOCUMENTS

| | | | |
|---|---|---|---|
| WO | 01/76321 | A1 | 10/2001 |
| WO | 2012/066149 | A1 | 5/2012 |

OTHER PUBLICATIONS

Extended European Search Report dated Oct. 22, 2013 for related EP Patent Application No. EP 13173995.5, 6 pages.
First Technical Examination and Search Report dated Dec. 20, 2013 for related Danish Patent Application No. PA 2013 70356, 7 pages.
First Technical Examination dated Jul. 11, 2014, for related Danish Patent Application No. PA 2013 70356, 3 pages.

*Primary Examiner* — Brian Ensey
(74) *Attorney, Agent, or Firm* — Vista IP Law Group, LLP

(57) ABSTRACT

A new hearing aid system is provided, comprising a location detector, e.g. a GPS receiver, for determination of the geographical position of the user of the hearing aid system, and an environment detector configured for determination of the type of sound environment surrounding the user of the hearing aid system based on sound as received by the hearing aid system and the geographical position of the hearing aid system as determined by the location detector.

19 Claims, 4 Drawing Sheets

HEARING AID OPERATING IN DEPENDENCE OF POSITION

RELATED APPLICATION DATA

This application claims priority to and the benefit of Danish Patent Application No. PA 2013 70356, filed on Jun. 27, 2013, and European Patent Application No. 13173995.5, filed on Jun. 27, 2013. The entire disclosures of both of the above applications are expressly incorporated by reference herein.

FIELD OF TECHNOLOGY

A new hearing aid system is provided, comprising a location detector, e.g. including at least one of a GPS receiver, a calendar system, a WIFI network interface, a mobile phone network interface, etc, for determination of the geographical position of the user of the hearing aid system, and an environment detector configured for determination of the type of sound environment surrounding the user of the hearing aid system based on sound as received by the hearing aid system and the geographical position of the hearing aid system as determined by the location detector.

BACKGROUND

Today's conventional hearing aids typically comprise a Digital Signal Processor (DSP) for processing of sound received by the hearing aid for compensation of the user's hearing loss. As is well known in the art, the processing of the DSP is controlled by a signal processing algorithm having various parameters for adjustment of the actual signal processing performed. The gains in each of the frequency channels of a multi-channel hearing aid are examples of such parameters.

The flexibility of the DSP is often utilized to provide a plurality of different algorithms and/or a plurality of sets of parameters of a specific algorithm. For example, various algorithms may be provided for noise suppression, i.e. attenuation of undesired signals and amplification of desired signals. Desired signals are usually speech or music, and undesired signals can be background speech, restaurant clatter, music (when speech is the desired signal), traffic noise, etc.

The different algorithms or parameter sets are typically included to provide comfortable and intelligible reproduced sound quality in different sound environments, such as speech, babble speech, restaurant clatter, music, traffic noise, etc. Audio signals obtained from different sound environments may possess very different characteristics, e.g. average and maximum sound pressure levels (SPLs) and/or frequency content.

Therefore, in a hearing aid with a DSP, each type of sound environment may be associated with a particular program wherein a particular setting of algorithm parameters of a signal processing algorithm provides processed sound of optimum signal quality in the type of sound environment in question. A set of such parameters may typically include parameters related to broadband gain, corner frequencies or slopes of frequency-selective filter algorithms and parameters controlling e.g. knee-points and compression ratios of Automatic Gain Control (AGC) algorithms.

Consequently, today's DSP based hearing instruments are usually provided with a number of different programs, each program tailored to a particular sound environment category and/or particular user preferences. Signal processing characteristics of each of these programs is typically determined during an initial fitting session in a dispenser's office and programmed into the instrument by activating corresponding algorithms and algorithm parameters in a non-volatile memory area of the hearing aid and/or transmitting corresponding algorithms and algorithm parameters to the non-volatile memory area.

Some known hearing aids are capable of automatically classifying the user's sound environment into one of a number of relevant or typical everyday sound environment categories, such as speech, babble speech, restaurant clatter, music, traffic noise, etc.

Obtained classification results may be utilised in the hearing aid to automatically select signal processing characteristics of the hearing aid, e.g. to automatically switch to the most suitable algorithm for the environment in question. Such a hearing aid will be able to maintain optimum sound quality and/or speech intelligibility for the individual hearing aid user in various sound environments.

US 2007/0140512 A1 and WO 01/76321 disclose examples of classifier approaches.

SUMMARY

A new hearing aid system is provided with a hearing aid that includes the geographical position of a user of the new hearing aid system in its determination of the sound environment.

The sound environment within a certain geographical area typically remains in the same category over time. Thus, incorporation of the geographical position in the determination of the current sound environment will improve the determination, i.e. the determination may be made faster, and/or the determination may be made with increased certainty.

Thus, a new hearing aid system is provided, comprising a first hearing aid with

- a first microphone for provision of a first audio input signal in response to sound signals received at the first microphone in a sound environment,
- a first processor that is configured to process the first audio input signal in accordance with a first signal processing algorithm to generate a first hearing loss compensated audio signal,
- a first output transducer for conversion of the first hearing loss compensated audio signal to a first acoustic output signal,
- a first sound environment detector configured for
  - determination of the type of sound environment surrounding a user of the hearing aid system, and for
  - provision of a first output for selection of the first signal processing algorithm of the first processor based on the determined type of sound environment, and
- a location detector, e.g. including at least one of a GPS receiver, a calendar system, a WIFI network interface, a mobile phone network interface, etc, configured for determining the geographical position of the hearing aid system.

The first sound environment detector is configured for determination of the type of sound environment surrounding the user of the hearing aid system based on the first audio input signal and the geographical position of the hearing aid system.

The hearing aid may be of any type configured to be head worn at, and shifting position and orientation together with, the head, such as a BTE, a RIE, an ITE, an ITC, a CIC, etc, hearing aid.

Throughout the present disclosure, the term GPS receiver is used to designate a receiver of satellite signals of any satellite navigation system that provides location and time information anywhere on or near the Earth, such as the satellite navigation system maintained by the United States government and freely accessible to anyone with a GPS receiver and typically designated "the GPS-system", the Russian GLObal NAvigation Satellite System (GLONASS), the European Union Galileo navigation system, the Chinese Compass navigation system, the Indian Regional Navigational 20 Satellite System, etc, and also including augmented GPS, such as StarFire, Omnistar, the Indian GPS Aided Geo Augmented Navigation (GAGAN), the European Geostationary Navigation Overlay Service (EGNOS), the Japanese Multifunctional Satellite Augmentation System (MSAS), etc. In augmented GPS, a network of ground-based reference stations measure small variations in the GPS satellites' signals, correction messages are sent to the GPS system satellites that broadcast the correction messages back to Earth, where augmented GPS-enabled receivers use the corrections while computing their positions to improve accuracy. The International Civil Aviation Organization (ICAO) calls this type of system a satellite-based augmentation system (SBAS).

Throughout the present disclosure, a calendar system is a system that provides users with an electronic version of a calendar with data that can be accessed through a network, such as the Internet. Well-known calendar systems include, e.g., Mozilla Sunbird, Windows Live Calendar, Google Calendar, Microsoft Outlook with Exchange Server, etc. The hearing aid may further comprise one or more orientation sensors, such as gyroscopes, e.g. MEMS gyros, tilt sensors, roll ball switches, etc, configured for outputting signals for determination of orientation of the head of a user wearing the hearing aid, e.g. one or more of head yaw, head pitch, head roll, or combinations hereof, e.g. inclination or tilt.

Throughout the present disclosure, the word "tilt" denotes the angular deviation from the heads normal vertical position, when the user is standing up or sitting down. Thus, in a resting position of the head of a person standing up or sitting down, the tilt is 0°, and in a resting position of the head of a person lying down, the tilt is 90°.

The first sound environment detector may be configured for provision of the first output for selection of the first signal processing algorithm of the first processor based on user head orientation as determined based on the output signals of the one or more orientation sensors. For example, if the user changes position from sitting up to lying down in order to take a nap, the environment detector may cause the first signal processor to switch program accordingly, e.g. the first hearing aid may be automatically muted.

Alternatively, the output signals of the one or more orientation sensors may be input to another part of the hearing aid system, e.g. the first processor, configured for selection of the signal processing algorithm of the first processor based on the output signals of the one or more orientation sensors and the output of the first sound environment detector.

The signal processing algorithm may comprise a plurality of sub-algorithms or sub-routines that each performs a particular subtask in the signal processing algorithm. As an example, the signal processing algorithm may comprise different signal processing sub-routines such as frequency selective filtering, single or multi-channel compression, adaptive feedback cancellation, speech detection and noise reduction, etc.

Furthermore, several distinct selections of the above-mentioned signal processing sub routines may be grouped together to form two, three or more different pre-set listening programs which the user may be able to select between in accordance with his/hers preferences.

The signal processing algorithm will have one or several related algorithm parameters. These algorithm parameters can usually be divided into a number of smaller parameters sets, where each such algorithm parameter set is related to a particular part of the signal processing algorithm or to particular sub-routine as explained above. These parameter sets control certain characteristics of their respective subroutines such as corner-frequencies and slopes of filters, compression thresholds and ratios of compressor algorithms, adaptation rates and probe signal characteristics of adaptive feedback cancellation algorithms, etc.

Values of the algorithm parameters are preferably intermediately stored in a volatile data memory area of the processing means such as a data RAM area during execution of the signal processing algorithm. Initial values of the algorithm parameters are stored in a non-volatile memory area such as an EEPROM/Flash memory area or battery backed-up RAM memory area to allow these algorithm parameters to be retained during power supply interruptions, usually caused by the user's removal or replacement of the hearing aid's battery or manipulation of an ON/OFF switch.

The location detector, e.g. including a GPS receiver, may be included in the first hearing aid for determining the geographical position of the user, when the user wears the hearing aid in its intended operational position on the head, based on satellite signals in the well-known way. Hereby, the user's current position and possibly orientation can be provided, e.g. to the first environment detector, based on data from the first hearing aid.

The first environment detector may be included in the first hearing aid, whereby signal transmission between the environment detector and other circuitry of the hearing aid is facilitated.

Alternatively, the location detector, e.g. including the GPS receiver, may be included in a hand-held device that is interconnected with the hearing aid.

The hand-held device may be a GPS receiver, a smart phone, e.g. an Iphone, an Android phone, windows phone, etc, e.g. with a GPS receiver, and a calendar system, etc, interconnected with the hearing aid.

The first environment detector may be included in the hand-held device. The first environment detector may benefit from the larger computing resources and power supply typically available in a hand-held device as compared with the limited computing resources and power available in a hearing aid.

The hand-held device may accommodate a user interface configured for user control of the hearing aid system including the first hearing aid.

The hand-held device may have an interface for connection with a Wide-Area-Network, such as the Internet.

The hand-held device may access the Wide-Area-Network through a mobile telephone network, such as GSM, IS-95, UMTS, CDMA-2000, etc.

Through the Wide-Area-Network, e.g. the Internet, the hand-held device may have access to electronic time management and communication tools used by the user for communication and for storage of time management and communication information relating to the user. The tools and the stored information typically reside on a remote server accessed through the Wide-Area-Network.

A processor of the hand-held device may be configured for storing hearing aid parameters together with GPS-data in the Cloud, i.e. on a remote server accessed through the Internet, possibly together with a hearing profile of the user, e.g. for backup of hearing aid settings at various GPS-locations, and/or for sharing of hearing aid settings at various GPS-locations with other hearing aid users.

Thus, the processor of the hand-held device may be configured for retrieving a hearing aid setting of another user made at the current GPS-location. The hearing aid settings may be grouped according to hearing profile similarities and/or age and/or race and/or ear size, etc, and the hearing aid setting of another user may be selected in accordance with the user's belonging to such groups.

The hearing aid may comprise a data interface for transmission of control signals from the hand-held device to other parts of the hearing aid system, including the first hearing aid.

The hearing aid may comprise a data interface for transmission of the output of the one or more orientation sensors to the hand-held device.

The data interface may be a wired interface, e.g. a USB interface, or a wireless interface, such as a Bluetooth interface, e.g. a Bluetooth Low Energy interface.

The hearing aid may comprise an audio interface for reception of an audio signal from the hand-held device and possibly other audio signal sources.

The audio interface may be a wired interface or a wireless interface. The data interface and the audio interface may be combined into a single interface, e.g. a USB interface, a Bluetooth interface, etc.

The hearing aid may for example have a Bluetooth Low Energy data interface for exchange of sensor and control signals between the hearing aid and the hand-held device, and a wired audio interface for exchange of audio signals between the hearing aid and the hand-held device.

The first sound environment detector may comprise a first feature extractor for determination of characteristic parameters of the first audio input signal.

The feature extractor may determine characteristic parameters of the audio input signal, such as average and maximum sound pressure levels (SPLs), signal power, spectral data and other well-known features. Spectral data may include Discrete Fourier Transform coefficients, Linear Predictive Coding parameters, cepstrum parameters or corresponding differential cepstrum parameters.

The feature extractor may output the characteristic parameters to a first environment classifier configured for categorizing the sound environment based on the determined characteristic parameters and the geographical position.

The first environment classifier is configured for categorization of sound environments into a number of sound environment classes or categories, such as speech, babble speech, restaurant clatter, music, traffic noise, etc. The classification process may utilise a simple nearest neighbour search, a neural network, a Hidden Markov Model system or another system capable of pattern recognition. The output of the environmental classification can be a "hard" classification containing one single environmental class or a set of probabilities indicating the probabilities of the sound belonging to the respective classes. Other outputs may also be applicable.

The first environment classifier may output a determined sound environment category to a first parameter map configured for provision of the output for selection of the corresponding first signal processing algorithm of the first processor.

In this way, obtained classification results may be utilised in the hearing aid to automatically select signal processing characteristics of the hearing aid, e.g. to automatically switch to the most suitable algorithm for the sound environment in question. Such a hearing aid will be able to maintain optimum sound quality and/or speech intelligibility for the individual hearing aid user in various sound environments.

As an example, it may be desirable to switch between an omni-directional and a directional microphone preset program in dependence of, not just the level of background noise, but also on further signal characteristics of this background noise. In situations where the user of the hearing aid communicates with another individual in the presence of the background noise, it would be beneficial to be able to identify and classify the type of background noise. Omni-directional operation could be selected in the event that the noise being traffic noise to allow the user to clearly hear approaching traffic independent of its direction of arrival. If, on the other hand, the background noise was classified as being babble-noise, the directional listening program could be selected to allow the user to hear a target speech signal with improved signal-to-noise ratio (SNR) during a conversation.

Applying Hidden Markov Models for analysis and classification of the microphone signal may for example obtain a detailed characterisation of e.g. a microphone signal. Hidden Markov Models are capable of modeling stochastic and non-stationary signals in terms of both short and long time temporal variations.

The environment detector may be configured for recording the geographical position determined by the location detector together with the determined type of sound environment at the geographical position. Recording may be performed at regular time intervals, and/or with a certain geographical distance between recordings, and/or triggered by certain events, e.g. a shift in type of sound environment, a change in signal processing, such as a change in signal processing programme, a change in signal processing parameters, etc., etc.

When the hearing aid system is located within a threshold distance from a geographical position of a previous recording of a determined type of sound environment and/or within an area of previously recorded geographical positions with identical recordings of the type of sound environment, the environment detector may be configured for increasing the probability that the current sound environment is of the same type as already recorded at or proximate the current geographical position, or, determining that the current sound environment is of the already recorded type of sound environment.

The threshold distance may be predetermined, e.g. reflecting the uncertainty of the determination of geographical position of the location detector, e.g. less than or equal to the uncertainty of the location detector, or less than or equal to an average distance between recordings of geographical position and type of sound environment, or less than a characteristic size of significant features at the current geographical position such as a sports arena, a central station, a city hall, a theatre, etc. The threshold distance may also be adapted to the current environment, e.g. resulting in relatively small threshold distances in areas, e.g. urban areas, with short distances between recordings of different types of sound environments, and resulting in relatively large threshold distances in areas, e.g. open ranges, with large distances between recordings of different types of sound environments.

A user interface of the hearing aid system may be configured to allocate certain types of sound environment to certain geographical areas.

In absence of useful GPS signals, the location detector may determine the geographical position of the hearing aid system based on the postal address of a WIFI network the hearing aid system may be connected to, or by triangulation based on signals possibly received from various GSM-transmitters as is well-known in the art of mobile phones. Further, the location detector may be configured for accessing a calendar system of the user to obtain information on the expected whereabouts of the user, e.g. meeting room, office, canteen, restaurant, home, etc and to include this information in the determination of the geographical position. Thus, Information from the calendar system of the user may substitute or supplement information on the geographical position determined by otherwise, e.g. by a GPS receiver.

For example, the environment detector may automatically switch the hearing aid(s) of the hearing aid system to flight mode, i.e. radio(s) of the hearing aid(s) are turned off, when the user is in an airplane according to the location detector.

Also, when the user is inside a building, e.g. a high rise building, GPS signals may be absent or so weak that the geographical position cannot be determined by a GPS receiver. Information from the calendar system on the whereabouts of the user may then be used to provide information on the geographical position, or information from the calendar system may supplement information on the geographical position, e.g. indication of a specific meeting room may provide information on which floor in a high rise building, the hearing aid system is located. Information on height is typically not available from a GPS receiver.

The location detector may automatically use information from the calendar system, when the geographical position cannot be determined otherwise, e.g. when the GPS-receiver is unable to provide the geographical position. In the event that no information on geographical position is available to the location detector, e.g. from the GPS receiver and the calendar system, the environment detector may determine the type of sound environment in a conventional way based on the received sound signal; or, the hearing aid may be set to operate in a mode selected by the user, e.g. previously during a fitting session, or when the situation occurs.

The new hearing aid system may be a binaural hearing aid system with two hearing aids, one for the right ear and one for the left ear of the user.

Thus, the new hearing aid system may comprise a second hearing aid with a second microphone for provision of a second audio input signal in response to sound signals received at the second microphone in a sound environment, a second processor that is configured to process the second audio input signal in accordance with a second signal processing algorithm to generate a second hearing loss compensated audio signal, a second output transducer for conversion of the second hearing loss compensated audio signal to a second acoustic output signal.

The circuitry of the second hearing aid is preferably identical to the circuitry of the first hearing aid apart from the fact that the second hearing aid, typically, is adjusted to compensate a hearing loss that is different from the hearing loss compensated by the first hearing aid, since; typically, binaural hearing loss differs for the two ears.

The first sound environment detector may be configured for determination of the type of sound environment surrounding the user of the hearing aid system based on the first and second audio input signals and the geographical position of the hearing aid system.

The first sound environment detector may be configured for provision of a second output for selection of a second signal processing algorithm of the second processor.

Alternatively, the second hearing aid may comprise a second sound environment detector similar to the first sound environment detector and configured for determination of the type of sound environment surrounding a user of the hearing aid system based on the first and second audio input signals and the geographical position of the hearing aid system, and for provision of a second output for selection of the second signal processing algorithm of the second processor.

In binaural hearing aid systems, it is important that the signal processing algorithms of the first and second signal processors are selected in a coordinated way. Since sound environment characteristics may differ significantly at the two ears of a user, it will often occur that independent sound environment determination at the two ears of a user differs, and this may lead to undesired different signal processing of sounds in the hearing aids. Thus, preferably the signal processing algorithms of the first and second processors are selected based on the same signals, such as sound signals received at the hand-held device, or both sound signals received at the left ear and sound signals received at the right ear, or a combination of sound signals received at the hand-held device and sound signals received at the left ear and sound signals received at the right ear, etc.

Like the first sound environment detector, the second sound environment detector may comprise a second feature extractor for determination of characteristic parameters of the second audio input signal.

The second feature extractor may output the characteristic parameters to a second environment classifier for categorizing the sound environment based on the determined characteristic parameters and the geographical position.

The second environment classifier may output a sound environment category to a second parameter map configured for provision of the output for selection of the second signal processing algorithm of the second processor.

A hearing aid system includes: a first hearing aid with a first microphone for provision of a first audio input signal in response to sound signals received at the first microphone in a sound environment, a first processor that is configured to process the first audio input signal in accordance with a first signal processing algorithm to generate a first hearing loss compensated audio signal, and a first output transducer for conversion of the first hearing loss compensated audio signal to a first acoustic output signal; a first sound environment detector configured for determining a type of sound environment surrounding a user of the hearing aid system, and for provision of a first output for selection of the first signal processing algorithm based on the determined type of sound environment; and a location detector configured for determining a geographical position of the hearing aid system; wherein the first sound environment detector is configured for determining the type of sound environment surrounding the user of the hearing aid system based on the first audio input signal and the geographical position of the hearing aid system.

Optionally, the location detector includes a GPS receiver.

Optionally, the first sound environment detector is configured for recording the geographical position determined by the location detector together with the type of sound environment at the geographical position.

Optionally, the first sound environment detector is configured for determining the type of sound environment by considering a probability of occurrence for a previously recorded type of sound environment that is within a distance threshold from the determined geographical position.

Optionally, the hearing aid system further includes a user interface configured to allocate certain sound environment categories to certain respective geographical areas.

Optionally, the location detector is configured for accessing a calendar system of the user to obtain information regarding a location of the user, and to determine the geographical position of the hearing aid system based on the information regarding the location of the user.

Optionally, the location detector is configured for automatically accessing the calendar system of the user to obtain the information regarding the location of the user, and to determine the geographical position of the hearing aid system based on the information regarding the location of the user, when the location detector is otherwise unable to determine the geographical position of the hearing aid system.

Optionally, the location detector is configured for obtaining a height of the geographical position from the calendar system.

Optionally, the first sound environment detector is configured for automatically switching the first hearing aid of the hearing aid system to a flight mode, when the user is in an airplane according to the location detector.

Optionally, the first hearing aid comprises at least one orientation sensor configured for providing information regarding an orientation of a head of the user when the user wears the first hearing aid in its intended operating position.

Optionally, the first hearing aid is configured for selection of the first signal processing algorithm based on the information regarding the orientation of the head of the user.

Optionally, the hearing aid system further includes a hand-held device communicatively coupled with the first hearing aid, the hand-held device accommodating the location detector.

Optionally, the hand-held device also accommodates the first sound environment detector.

Optionally, the hand-held device comprises a user interface configured for controlling the first hearing aid.

Optionally, the first hearing aid accommodates the first sound environment detector.

Optionally, the first sound environment detector comprises: a first feature extractor for determining characteristic parameters of the first audio input signal, a first environment classifier for categorizing the sound environment based on the determined characteristic parameters and the geographical position, and a first parameter map for provision of the first output for selection of the first signal processing algorithm.

Optionally, the hearing aid system further includes a second hearing aid with a second microphone for provision of a second audio input signal in response to sound signals received at the second microphone, a second processor that is configured to process the second audio input signal in accordance with a second signal processing algorithm to generate a second hearing loss compensated audio signal, a second output transducer for conversion of the second hearing loss compensated audio signal to a second acoustic output signal, wherein the first sound environment detector is configured for determining the type of sound environment surrounding the user of the hearing aid system based on the first and second audio input signals and the geographical position of the hearing aid system.

Optionally, the first sound environment detector is configured for provision of a second output for selection of the second signal processing algorithm.

Optionally, the second hearing aid comprises: a second sound environment detector configured for determining a type of sound environment surrounding the user of the hearing aid system based on the first and second audio input signals and the geographical position of the hearing aid system, and provision of a second output for selection of the second signal processing algorithm based on the type of sound environment determined by the second sound environment detector.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DETAILED DESCRIPTION

Figure 1:
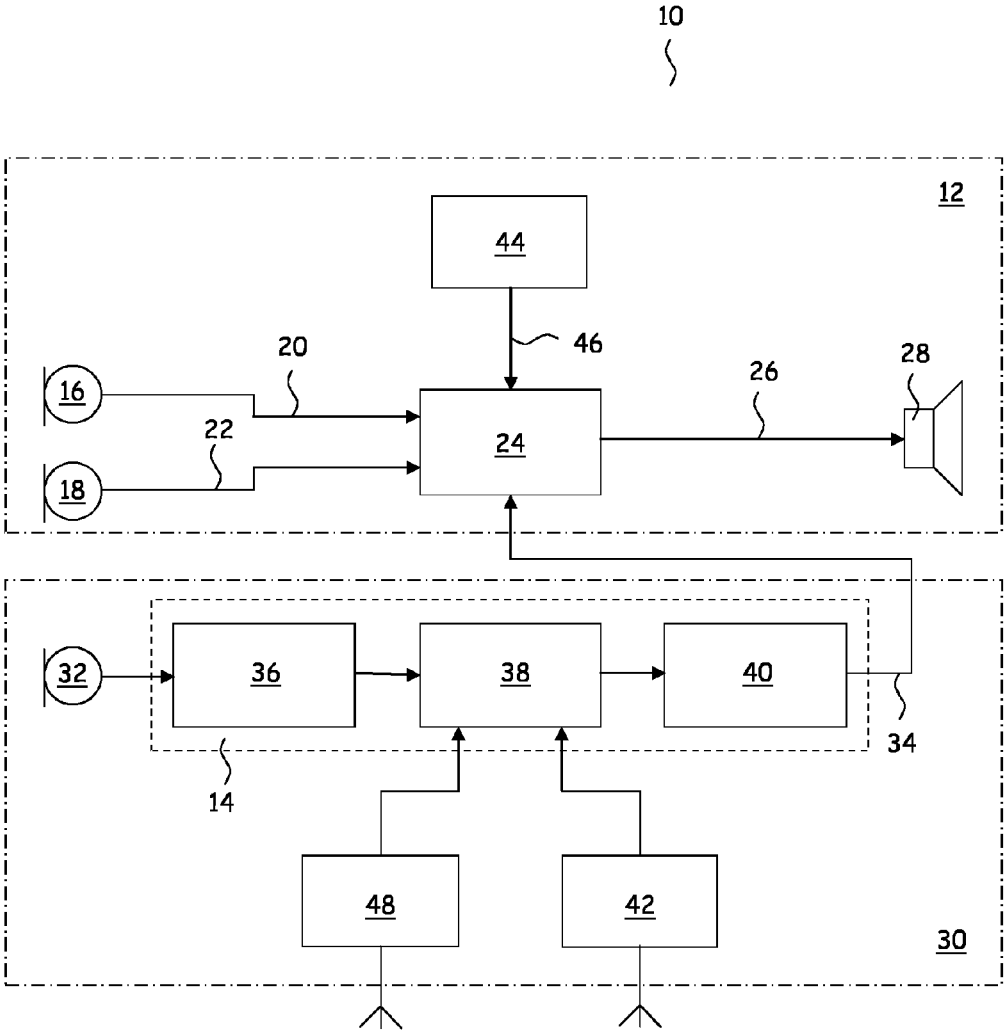
FIG. 1 shows a new hearing aid system with a single hearing aid with an orientation sensor and a hand-held device with a GPS receiver and a sound environment detector.

Various exemplary embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or not so explicitly described.

The new hearing aid system will now be described more fully hereinafter with reference to the accompanying drawings, in which various types of the new hearing aid system are shown. The new hearing aid system may be embodied in different forms not shown in the accompanying drawings and should not be construed as limited to the embodiments and examples set forth herein.

Similar reference numerals refer to similar elements in the drawings.

FIG. 1 schematically illustrates a new hearing aid system 10 with a first hearing aid 12 with a sound environment detector 14.

The first hearing aid 12 may be of any type configured to be head worn at the head, such as a BTE, a RIE, an ITE, an ITC, a CIC, etc, hearing aid.

The first hearing aid 12 comprises a first front microphone 16 and first rear microphone 18 connected to respective A/D converters (not shown) for provision of respective digital input signals 20, 22 in response to sound signals received at the microphones 16, 18 in a sound environment surrounding the user of the hearing aid system 10. The digital input signals 20, 22 are input to a hearing loss processor 24 that is configured to process the digital input signals 20, 22 in accordance with a signal processing algorithm to generate a hearing loss compensated output signal 26. The hearing loss compensated output signal 26 is routed to a D/A converter (not shown) and an output transducer 28 for conversion of the hearing loss compensated output signal 26 to an acoustic output signal.

The new hearing aid system 10 further comprises a hand-held device 30, e.g. a smart phone, accommodating the sound environment detector 14 for determination of the sound environment surrounding the user of the hearing aid system 10. The determination is based on a sound signal picked up by a microphone 32 in the hand-held device. Based on the determination, the sound environment detector 14 provides an output 34 to the hearing aid processor 24 for selection of the signal processing algorithm appropriate for the determined sound environment.

Thus, the hearing aid processor 24 is automatically switched to the most suitable algorithm for the determined environment whereby optimum sound quality and/or speech intelligibility is maintained in various sound environments. The signal processing algorithms of the processor 24 may perform various forms of noise reduction and dynamic range compression as well as a range of other signal processing tasks.

The first environment detector 14 benefits from the larger computing resources and power supply typically available in the hand-held device 30.

The sound environment detector 14 comprises a feature extractor 36 for determination of characteristic parameters of the received sound signals. The feature extractor 36 maps the signal from the microphone 32 onto sound features, i.e. the characteristic parameters. These features can be signal power, spectral data and other well-known features.

The sound environment detector 14 further comprises an environment classifier 38 for categorizing the sound environment based on the determined characteristic parameters output by the feature extractor 36. The environment classifier 38 categorizes the sounds into a number of environmental classes, such as speech, babble speech, restaurant clatter, music, traffic noise, etc. The classification process may utilise a simple nearest neighbour search, a neural network, a Hidden Markov Model system or another system capable of pattern recognition. The output of the environmental classification can be a "hard" classification containing one single environmental class or a set of probabilities indicating the probabilities of the sound belonging to the respective classes. Other outputs may also be applicable.

The sound environment detector 14 further comprises a parameter map 40 for the provision of the output 34 for selection of the signal processing algorithms. The parameter map 40 maps the output of the environment classifier 38 to a set of parameters for the hearing aid sound processor 20. Examples of such parameters are: Amount of noise reduction, amount of gain and amount of HF gain. Other parameters may be included.

The hand-held device 30 includes a location detector with a GPS receiver 42 configured for determining the geographical position of the hearing aid system 10. The illustrated hand-held device 30 is a smart phone also having mobile interface 48 comprising a GSM-interface for interconnection with a mobile phone network and a WIFI interface 48 as is well-known in the art of mobile phones. In absence of useful GPS signals, the position of the illustrated hearing aid system 10 may be determined as the address of the WIFI network or by triangulation based on signals received from various GSM-transmitters as is well-known in the art of mobile phones.

The illustrated environment detector 14 is configured for recording the determined geographical positions together with the determined types of sound environment at the respective geographical positions. Recording may be performed at regular time intervals, and/or with a certain geographical distance between recordings, and/or triggered by certain events, e.g. a shift in type of sound environment, a change in signal processing, such as a change in signal processing programme, a change in signal processing parameters, etc., etc.

When the hearing aid system 10 is located within an area of geographical positions with recordings of the same type of sound environment, the environment detector is configured for increasing the probability that the current sound environment is of the same type of sound environment, or, determining that the current sound environment is of the same type of sound environment.

A user interface (not shown) of the hearing aid system 10 may be configured to allocate certain types of sound environment to certain geographical areas.

The illustrated sound environment detector 14 is also configured for accessing a calendar system of the user, e.g. through the mobile interface 48, to obtain information on the whereabouts of the user, e.g. meeting room, office, canteen, restaurant, home, etc, and to include this information in the determination of the type of sound environment. Information from the calendar system of the user may substitute or supplement information on the geographical position determined by the GPS receiver.

For example, the environment detector 14 may automatically switch the hearing aid(s) of the hearing aid system 10 to flight mode, i.e. radio(s) of the hearing aid(s) are turned off, when the user is in an airplane as indicated in the calendar system of the user.

Also, when the user is inside a building, e.g. a high rise building, GPS signals may be absent or so weak that the geographical position cannot be determined by the GPS receiver. Information from the calendar system on the whereabouts of the user may then be used to provide information on the geographical position, or information from the calendar system may supplement information on the geographical position, e.g. indication of a specific meeting room may provide information on the floor in a high rise building. Information on height is typically not available from a GPS receiver.

The environment detector 14 may automatically use information from the calendar system, when the GPS-receiver is unable to provide the geographical position. In the event that no information on geographical position is available from the GPS receiver and calendar system, the environment detector may determine the type of sound environment in a conventional way based on the received sound signal; or, the hearing aid may be set to operate in a mode selected by the user, e.g. previously during a fitting session, or when the situation occurs.

The hearing aid 12 comprises one or more orientation sensors 44, such as gyroscopes, e.g. MEMS gyros, tilt sensors, roll ball switches, etc, configured for outputting signals for determination of orientation of the head of a user wearing the hearing aid, e.g. one or more of head yaw, head pitch, head roll, or combinations hereof, e.g. tilt, i.e. the angular deviation from the heads normal vertical position, when the user is standing up or sitting down. E.g. in a resting position, the tilt of the head of a person standing up or sitting down is 0°, and in a resting position, the tilt of the head of a person lying down is 90°.

The first processor 24 is configured for selection of the first signal processing algorithm of the processor 24 based on user head orientation as determined based on the output signals 46 of the one or more orientation sensors 44 and the output control signal 34 of the first sound environment detector 14. For example, if the user changes position from sitting up to lying down in order to take a nap, the environment detector 14 may cause the signal processor 24 to switch program accordingly, e.g. the first hearing aid 12 may be automatically muted.

Figure 2:
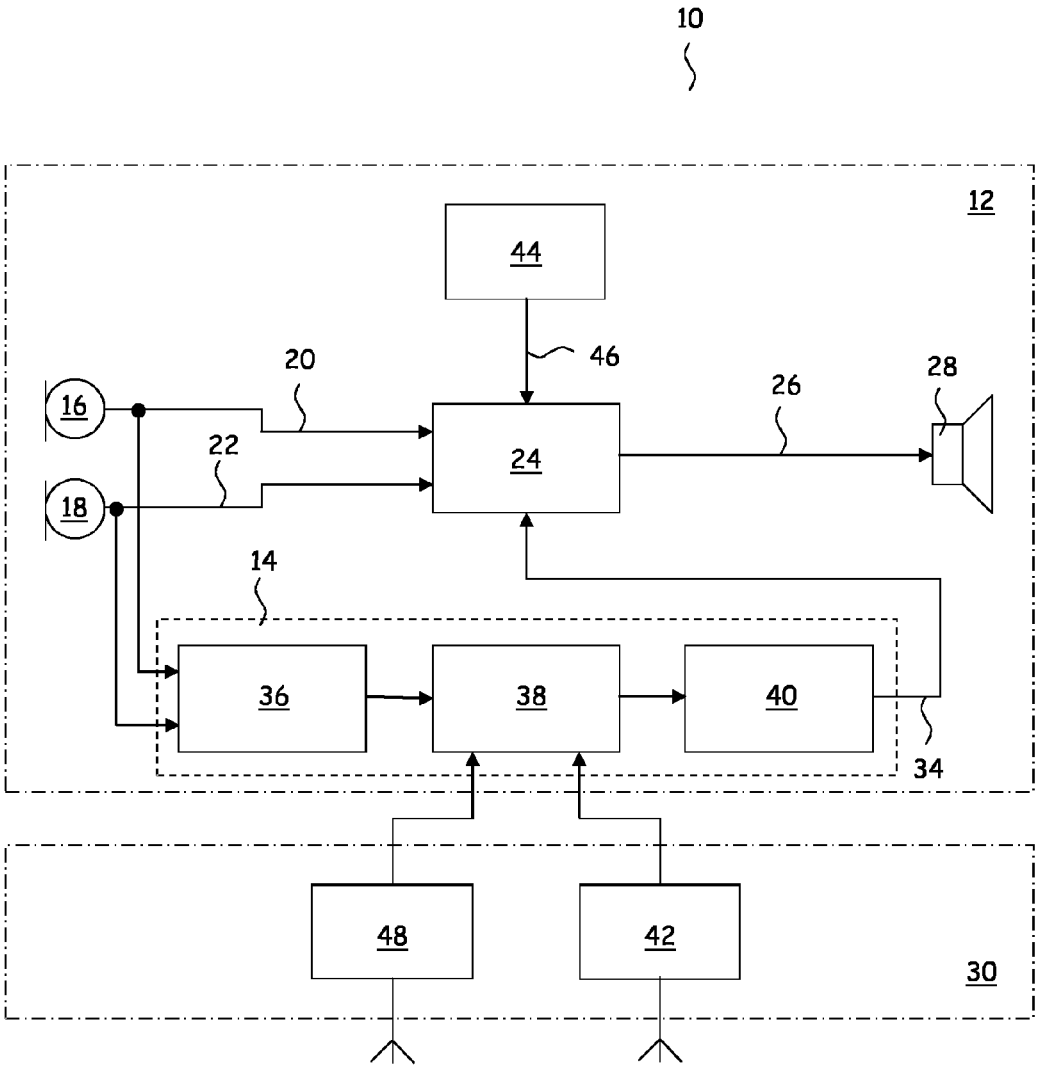
FIG. 2 shows a new hearing aid system with a single hearing aid with an orientation sensor and a sound environment detector and a hand-held device with a GPS receiver.

The new hearing system 10 shown in FIG. 2 is similar to the new hearing aid system of FIG. 1 and operates in the same way, except for the fact that the sound environment detector 14 has been moved from the hand-held device 30 in FIG. 1 to the first hearing aid 12 of FIG. 2. In this way, the microphone output signals 20, 22 can be connected directly to the sound environment detector 14 so that the type of sound environment can be determined based on signals received by the microphones in the hearing aid without increasing data transmission requirements.

Figure 3:
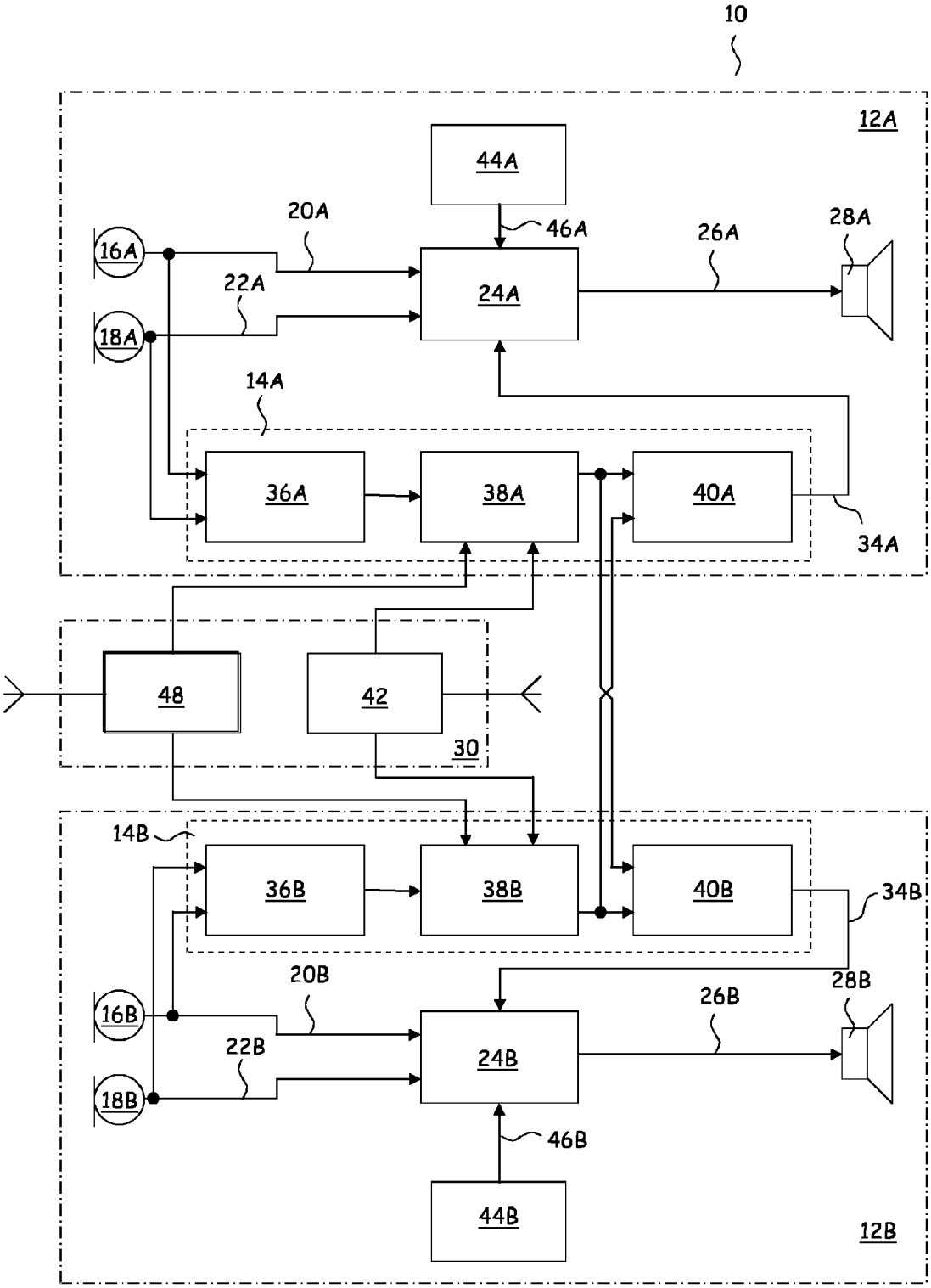
FIG. 3 shows a new hearing aid system with two hearing aids with orientation sensors and sound environment detectors and a hand-held device with a GPS receiver.

The new hearing aid system 10 shown in FIG. 3 is a binaural hearing aid system with two hearing aids, a first hearing aid 12A for the right ear and a second hearing aid 12B for the left ear of the user, and a hand-held device 30 comprising the GPS receiver 42 and the mobile interface 48.

Each of the illustrated first hearing aid 12A and second hearing aid 12B is similar to the hearing aid shown in FIG. 2 and operates in a similar way, except for the fact that the respective sound environment detectors 14A, 14B co-operate to provide co-ordinated selection of signal processing algorithms in the two hearing aids 12A, 12B as further explained below.

Each of the first and second hearing aids 12A, 12B' of the binaural hearing aid system 10 comprises a binaural sound environment detector 14A, 14B for determination of the sound environment surrounding a user of the binaural hearing aid system 10. The determination is based on the output signals of the microphones 20A, 22A, 20B, 22B. Based on the determination, the binaural sound environment detector 14A, 14B provides outputs 34A, 34B to the respective hearing aid processors 24A, 24B for selection of the signal processing algorithm appropriate for the determined sound environment. Thus, the binaural sound environment detectors 14A, 14B determine the sound environment based on signals from both hearing aids, i.e. binaurally, whereby hearing aid processors 24A, 24B are automatically switched in co-ordination to the most suitable algorithm for the determined sound environment whereby optimum sound quality and/or speech intelligibility are maintained in various sound environments by the binaural hearing aid system 10.

The binaural sound environment detectors 14A, 14B illustrated in FIG. 3 are both similar to the sound environment detector 14 shown in FIG. 2 apart from the fact that the first environment detector 14 only receives inputs from one hearing aid 12 while each of the binaural sound environment detectors 14A, 14B receives inputs from both hearing aids 12A, 12B. Thus, in FIG. 3, signals are transmitted between the hearing aids 12A, 12B so that the algorithms executed by the signal processors 24A, 24B are selected in coordination.

In FIG. 3, the output of the environment classifier 14A of the first hearing aid 12A is transmitted to the second hearing aid 12B, and the output of the environment classifier 14B of the second hearing aid 12B is transmitted to the first hearing aid 12A. The parameter maps 40A, 40B of the first and second hearing aids 12A, 12B then operate based on the same two inputs to produce the control signals 34A, 34B for selection of the processor algorithms, and since the parameter mapping units 34A, 34B receive identical inputs, algorithm selections in the two hearing aids 12A, 12B are co-ordinated.

The transmission data rate is low, since only a set of probabilities or logic values for the environment classes has to be transmitted between the hearing aids 12A, 12B. Rather high latency can be accepted. By applying time constants to the variables that will change according to the output of the parameter mapping, it is possible to smooth out differences that may be caused by latency. As already mentioned, it is important that signal processing in the two hearing instruments is coordinated. However if transition periods of a few seconds are allowed the system can operate with only 3-4 transmissions per second. Hereby, power consumption is kept low.

The sound environment detectors 14A, 14B incorporate determined positions provided by the hand-held unit 30 of the new hearing aid system 10 in the same way as disclosed above with reference to FIGS. 1 and 2.

Figure 4:
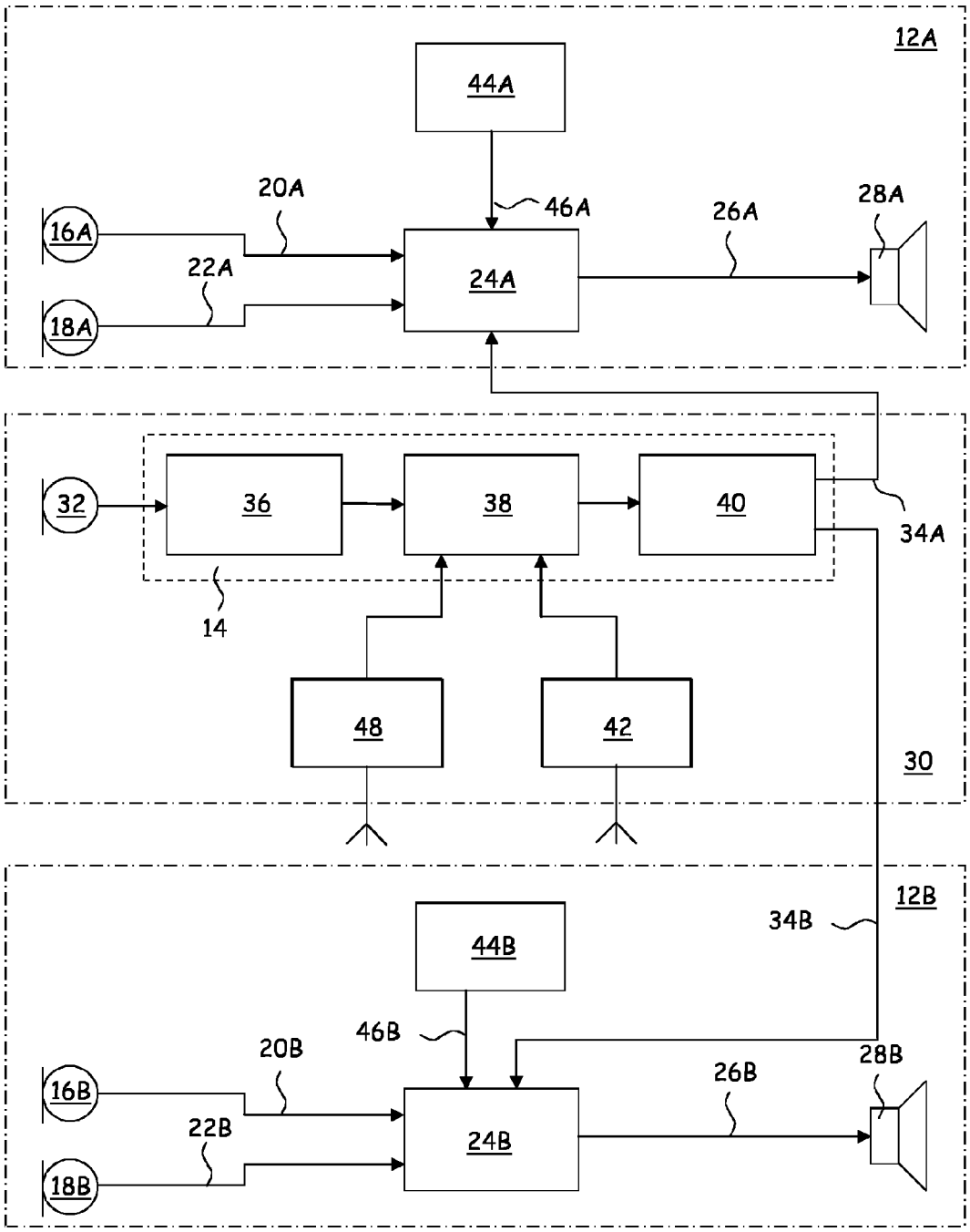
FIG. 4 shows a new hearing aid system with two hearing aids with orientation sensors and a hand-held device with a sound environment detector and a GPS receiver.

In the new binaural hearing aid system 10 shown in FIG. 4, co-ordinated signal processing in the two hearing aids 12A, 12B is obtained by provision of a single sound environment detector 14 similar to the sound environment detector shown in FIG. 1 and operating in a similar way apart from the fact that the sound environment detector 14 provides two control outputs 34A, 34B, one of which 34A is connected to the first hearing aid 12A, and the other of which 34B is connected to the second hearing aid 12B. The illustrated sound environment detector 14 is accommodated in the hand-held device 30.

Each of the hearing aids 12A, 12B is similar to the hearing aid 12 shown in FIG. 1 and operates in the same way.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid system comprising:

a first hearing aid with a first microphone for provision of a first audio input signal in response to sound signals received at the first microphone in a sound environment, a first processor that is configured to process the first audio input signal in accordance with a first signal processing algorithm to generate a first hearing loss compensated audio signal, and a first output transducer for conversion of the first hearing loss compensated audio signal to a first acoustic output signal;

a first sound environment detector configured for determining a type of sound environment surrounding a user of the hearing aid system, and for provision of a first output for selection of the first signal processing algorithm based on the determined type of sound environment; and a location detector configured for determining a geographical position of the hearing aid system;

wherein the first sound environment detector is configured for determining the type of sound environment surrounding the user of the hearing aid system based on the first audio input signal and the geographical position of the hearing aid system;

wherein the location detector is configured for accessing a calendar system of the user to obtain information regarding a location of the user.

2. The hearing aid system according to claim 1, wherein the location detector includes a GPS receiver.

3. The hearing aid system according to claim 1, wherein the first sound environment detector is configured for recording the geographical position determined by the location detector together with the type of sound environment at the geographical position.

4. The hearing aid system according to claim 3, wherein the first sound environment detector is configured for determining the type of sound environment by considering a probability of occurrence for a previously recorded type of sound environment that is within a distance threshold from the determined geographical position.

5. The hearing aid system according to claim 1, further comprising a user interface configured to allocate certain sound environment categories to certain respective geographical areas.

6. The hearing aid system according to claim 1, wherein the location detector is configured to determine the geographical position of the hearing aid system based on the information regarding the location of the user.

7. The hearing aid system according to claim 6, wherein the location detector is configured for automatically accessing the calendar system of the user to obtain the information regarding the location of the user, and to determine the geographical position of the hearing aid system based on the information regarding the location of the user, when the location detector is otherwise unable to determine the geographical position of the hearing aid system.

8. The hearing aid system according to claim 6, wherein the location detector is configured for obtaining a height of the geographical position from the calendar system.

9. The hearing aid system according to claim 1, wherein the first sound environment detector is configured for automatically switching the first hearing aid of the hearing aid system to a flight mode, when the user is in an airplane according to the location detector.

10. The hearing aid system according to claim 1, wherein the first hearing aid comprises at least one orientation sensor configured for providing information regarding an orientation of a head of the user when the user wears the first hearing aid in its intended operating position.

11. The hearing aid system according to claim 10, wherein the first hearing aid is configured for selection of the first signal processing algorithm based on the information regarding the orientation of the head of the user.

12. The hearing aid system according to claim 1, further comprising a hand-held device communicatively coupled with the first hearing aid, the hand-held device accommodating the location detector.

13. The hearing aid system according to claim 12, wherein the hand-held device also accommodates the first sound environment detector.

14. The hearing aid system according to claim 12, wherein the hand-held device comprises a user interface configured for controlling the first hearing aid.

15. The hearing aid system according to claim 1, wherein the first hearing aid accommodates the first sound environment detector.

16. The hearing aid system according to claim 1, wherein the first sound environment detector comprises:

a first feature extractor for determining characteristic parameters of the first audio input signal, a first environment classifier for categorizing the sound environment based on the determined characteristic parameters and the geographical position, and a first parameter map for provision of the first output for selection of the first signal processing algorithm.

17. The hearing aid system according to claim 1, further comprising a second hearing aid with a second microphone for provision of a second audio input signal in response to sound signals received at the second microphone, a second processor that is configured to process the second audio input signal in accordance with a second signal processing algorithm to generate a second hearing loss compensated audio signal, a second output transducer for conversion of the second hearing loss compensated audio signal to a second acoustic output signal, wherein the first sound environment detector is configured for determining the type of sound environment surrounding the user of the hearing aid system based on the first and second audio input signals and the geographical position of the hearing aid system.

18. The hearing aid system according to claim 17, wherein the first sound environment detector is configured for provision of a second output for selection of the second signal processing algorithm.

19. The hearing aid system according to claim 17, wherein the second hearing aid comprises:

a second sound environment detector configured for determining a type of sound environment surrounding the user of the hearing aid system based on the first and second audio input signals and the geographical position of the hearing aid system, and provision of a second output for selection of the second signal processing algorithm based on the type of sound environment determined by the second sound environment detector.

* * * * *